United States Patent [19]

Williams et al.

[11] Patent Number: 4,751,984

[45] Date of Patent: Jun. 21, 1988

[54] DYNAMICALLY GENERATED ADAPTIVE ELEVATOR VELOCITY PROFILE

[75] Inventors: Walter L. Williams, Denver; Donald G. McPherson, Westminster, both of Colo.; Arnold Mendelsohn, Simsbury, Conn.

[73] Assignee: Otis Elevator Company, Farmington, Conn.

[21] Appl. No.: 730,228

[22] Filed: May 3, 1985

[51] Int. Cl.[4] ..... B66B 1/30

[52] U.S. Cl. ..... 187/116; 187/118

[58] Field of Search ..... 187/29, 116, 118

[56] References Cited

U.S. PATENT DOCUMENTS

| | | | |
|---|---|---|---|
| 3,523,232 | 8/1970 | Hall et al. | 187/29 R |
| 3,526,300 | 8/1968 | Ferrot | 187/29 |
| 3,670,851 | 6/1972 | Shima | 187/29 R |
| 3,783,974 | 1/1974 | Gilbert et al. | 187/29 R |
| 4,131,183 | 12/1978 | Krauer | 187/29 R |
| 4,220,221 | 9/1980 | Gingrich | 187/29 R |
| 4,331,220 | 5/1982 | Husson | 187/29 R |
| 4,354,577 | 10/1982 | Yonemoto | 187/29 R |
| 4,434,874 | 3/1984 | Caputo | 187/29 R |
| 4,553,640 | 11/1985 | Inaba et al. | 187/29 R |

*Primary Examiner*—William M. Shoop, Jr.
*Assistant Examiner*—W. E. Duncanson, Jr.

[57] ABSTRACT

Elevator velocity profile generation is based upon combining an open loop, least time profile for acceleration with a precision closed loop, phase plane control for deceleration. The deceleration phase-plane velocity profile is generated as a modified mirror image of the acceleration profile, and transition from open loop control is within ride quality constraints. Adaptive control permits operating a drive unit closer to its limits without danger of overloading under worst case conditions, which account for a small percentage of the time. Thus, smaller drive units can be used in a given application with minimal impact on performance.

3 Claims, 7 Drawing Sheets

VELOCITY DICTATION CONTROL BLOCK

VELOCITY PROFILE–CRUISE AT CONTRACT SPEED

VELOCITY PROFILE – CONTRACT SPEED NOT REACHED

PHASE PLANE TABLE LOOKUP CONCEPT

MAXIMUM SHORT RUN PROFILE

SHORT RUN STOPPING DISTANCE COMPONENTS

PHASE PLANE TABLE CONSTRUCTION CONCEPT

STOPPING DISTANCE COMPONENTS

ILLUSTRATION OF LOOKAHEAD CONCEPTS

DYNAMICALLY GENERATED ADAPTIVE ELEVATOR VELOCITY PROFILE

DESCRIPTION

TECHNICAL FIELD OF THE INVENTION

The invention relates to elevator velocity control.

BACKGROUND OF THE INVENTION

Automatic elevator operation requires control of elevator velocity from zero, at the beginning and end of a trip, to speeds therebetween which minimize trip time while maintaining comfort levels and other contraints. The time change in velocity for a complete trip is termed "velocity profile". Automatic elevator control further requires control of the distance travelled during a trip in order to accomplish a precision stop at the destination floor.

Certain velocity profile generation strategies may lead to control instabilities. A common strategy is to use a phase-plane control for precision stopping, wherein dictated velocity is a function of the distance to go to the landing. As the distance-to-go approaches zero, the slope of the velocity/distance curve approaches infinity. Using linear control theory, it can be shown that the slope of the phase-plane curve represents the position error gain for phase-plane control and is proportional to position loop bandwidth. For the speed control loop to track the dictated velocity profile with stability, its bandwidth must be greater by a significant factor than the bandwidth of the position control loop.

One strategy for reducing the required bandwidth is to limit the slope of the phase-plane velocity versus position profile (position error gain) to a maximum value such that the position loop bandwidth is sufficiently lower than the velocity loop bandwidth. Since this theoretically requires an infinite time to reach zero distance-to-go, means must be provided for limiting the run time.

Generally, the torque producing capability of elevator motors may vary with speed due to motor current, voltage, and/or power limitations. If the drive is not capable of maintaining the acceleration limit under all conditions due to these torque limits, some means of reducing the acceleration, and hence torque, in the corresponding portions of the velocity profile must be provided without compromising operation of the drive at its limit or complicating the profile generation more than necessary. The primary problem is that, in order to meet the objectives of precision stopping with torque limiting, the location of the Stop Control Point (SCP) with respect to the destination floor will vary from run to run. (The SCP is that point in the trip where precision stopping maneuvers must be initiated.) In order to calculate the SCP, the deceleration profile must be known.

DISCLOSURE OF THE INVENTION

Therefore, it is an object of the invention to produce a minimum-time velocity profile, subject to the following constraints:

- Contract speed(s).
- Ride comfort constraints; i.e., acceleration and jerk limits.
- Control stability constraints; e.g., bandwidth limit.
- Drive torque limits, using adaptive control.

In addition, the velocity-profile generation approach must:

- Provide for precision stopping at the destination floor and releveling.
- Comply with the code required door zone and other terminal landing speed limits.
- Accommodate short runs where the contract speed is not reached, as well as very short runs where the Stop Control Point (SCP) is reached before the transition-to-constant-bandwidth velocity $V_{CB}$ (described below) is reached.

According to the invention, each segment of the velocity profile is generated at one of the limits constraining the system; viz., maximum jerk, maximum acceleration, maximum velocity, maximum position or loop gain, or maximum motor torque. The acceleration portion of a velocity profile is generated in an open loop manner beginning with constant (maximum) jerk, transitioning to constant (maximum) acceleration after an acceleration limit is attained, and jerking out (negative jerk) at a constant rate to maximum (contract) velocity when the maximum velocity is nearly attained. If the stop control point (SCP) is reached before maximum velocity is nearly attained, such as in a "short" run, jerk out begins at the SCP. The consequent velocity profile is modified and stored for use during deceleration in a closed loop, phase plane control. This gives an adaptive profile generation that accounts for bandwidth limits, as described below.

Other objects, features, and advantages of the invention will become more apparent in light of the following description thereof.

BEST MODE FOR CARRYING OUT THE INVENTION

In order to provide rapid, controlled and smooth motion control in an elevator, a velocity profile is generated which observes constraints regarding jerk, acceleration and equipment limitations. Typical requirements for a high performance system are:

RISE—up to 400 M
LOADS—900 TO 3600 KG
SPEEDS—2.5 to 10 M/S
ACCEL.—up to 1.5 M/S
JERK—up to 3.0 M/S
LEVELING—±0.006 M

Velocity control consists of satisfying two objectives. During starting, the object is to achieve full speed in the minimum time. When stopping, the object is to stop within an acceptable error in the shortest time. The first objective is accomplished by dictating velocity as a function of time at the jerk, acceleration, velocity, and motor torque limits. Since it is the end objective that distance-to-go should approach zero, the second objective is achieved by dictating velocity as a function of position, while approaching, but not exceeding jerk, acceleration, velocity, drive torque, or gain limits. To accomplish this strategy, continuous position information with sufficient accuracy is required, beginning with the initiation of stop until the final destination is reached.

Figure 1:
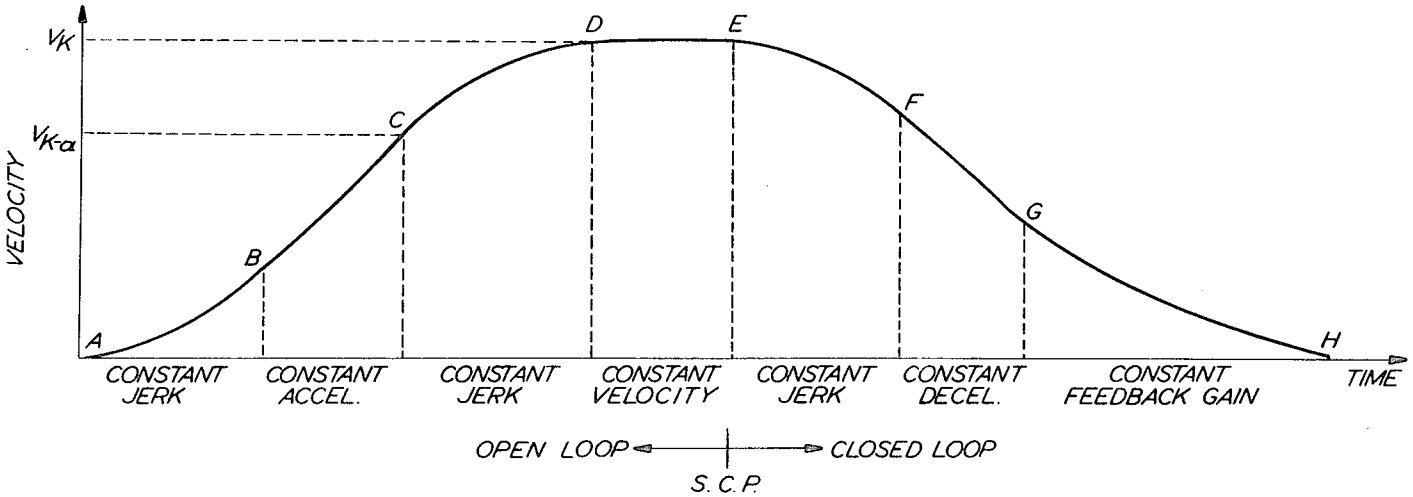
FIG. 1 is a graph of the velocity profile of this invention for runs where contract speed is achieved.

For trips of a distance great enough to permit some constant velocity travel, the velocity versus time profile is generated as shown in FIG. 1.

In an acceleration portion, the velocity profile is generated in an open loop manner. Beginning at a time A, constant (maximum) jerk is dictated until contract acceleration is reached at a time B. Then, acceleration remains constant until a velocity ($V_{K-a}$) approaching the contract velocity ($V_K$) is reached at time C. Then a constant negative jerk (jerk out) is applied to reduce acceleration to zero at time D, when the contract velocity is attained. The time interval D-E represents cruise at contract speed, for long enough runs. This results in a minimum time profile for achieving full speed ($V_K$) and is adaptive to equipment limitations. Point E is the stop control point (SCP), where the stopping distance, which is constantly calculated, equals the distance-to-go. The stopping distance is constantly calculated based on current velocity and acceleration dictation, thus assuring continuity, without blending, in the transition to phase plane.

The deceleration portion of the profile is generated in a closed loop, phase plane (position based) control. At the point E, the constant negative jerk, determined during the acceleration portion of the trip, is applied. Then, at a time F, when a deceleration limit is reached (which is nominally the negative of the acceleration limit), constant deceleration is dictated until a time G, whereupon constant feedback gain is dictated until the velocity is nearly zero, at a point H. Since velocity is proportional to position in the constant feedback gain region, the time profile follows an exponential curve which theoretically requires an infinite time to reach zero. Therefore, the point H is at some finite velocity, but is low enough to result in an acceptable jerk when the velocity dictation is set to zero. Constant feedback gain is imposed at the time G, which is determined in a manner discussed hereinafter, to avoid instability in the control loop.

Figure 2:
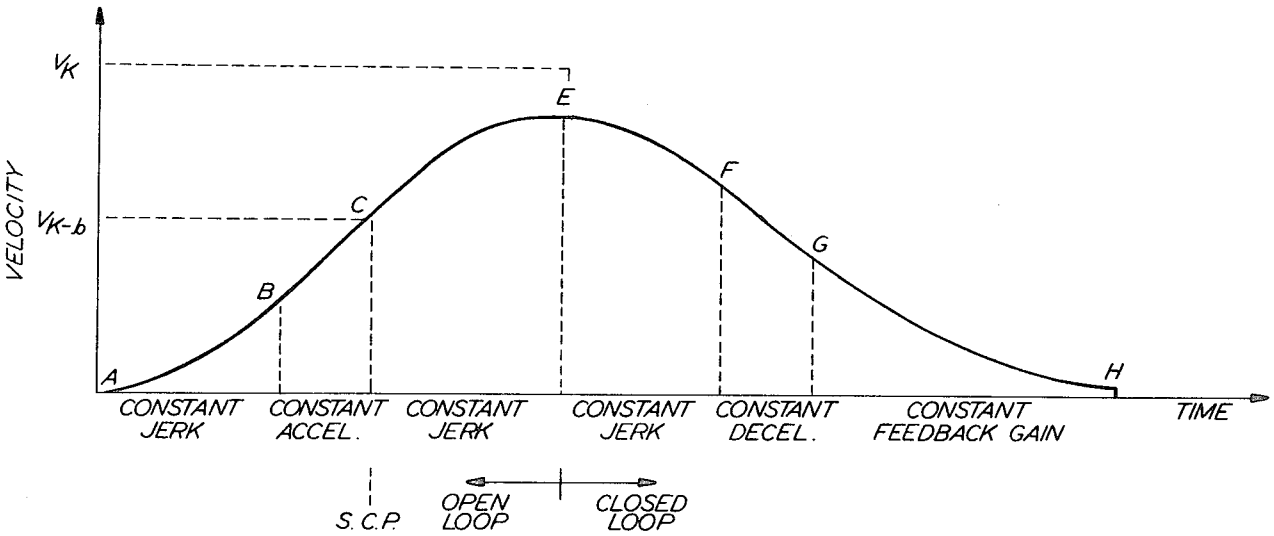
FIG. 2 is a graph of the velocity profile of this invention for runs where contract speed is not achieved.

Since stopping distance is constantly calculated based on current velocity and acceleration dictation, continuity is assured in the transition from open loop control to phase plane control. Because of this continuity requirement, jerk out is initiated earlier in the acceleration portion of the profile for short trips wherein contract speed is not attainable. As shown in FIG. 2, jerk out is initiated at a point C, which is the stop control point, at a velocity ($V_{K-b}$), which is less than the velocity ($V_{K-a}$) in the example in FIG. 1.

Figure 3:
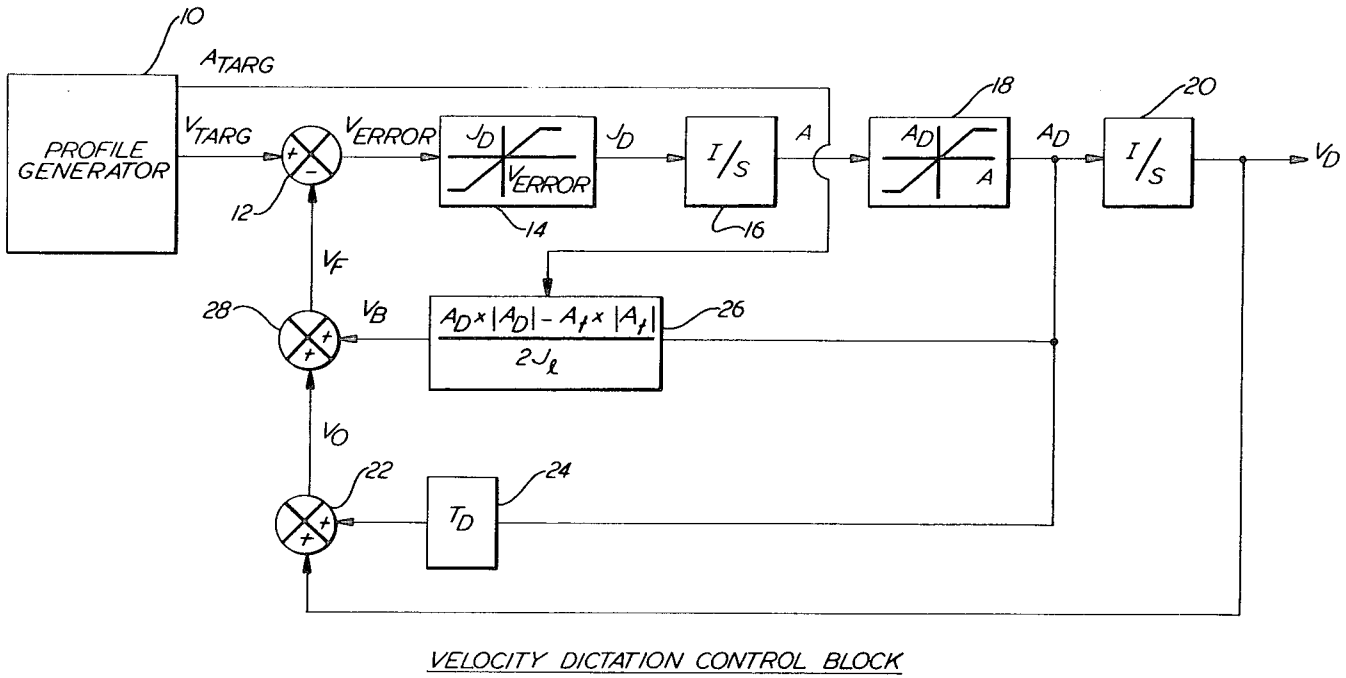
FIG. 3 is a block diagram of the velocity dictation control block of this invention.

The open loop control is implemented by setting a target velocity equal to the maximum contract velocity and a target acceleration equal to the maximum contract acceleration. As shown in the block diagram of FIG. 3, the target velocity ($V_{TARG}$) is provided by a microprocessor based target profile logic generator 10. The target velocity ($V_{TARG}$) is compared at a step 12 to a feedback velocity ($V_F$), and the error ($V_{error}$) between the two is used to calculate a limited jerk dictation ($J_D$) in a step 14. The jerk is then integrated (1/s) in a step 16 to give an acceleration (A) which is limited ($A_{D/A}$) in a step 18 to give a dictated acceleration ($A_D$). The dictated acceleration ($A_D$) is integrated (1/s) in a step 20 to give a dictated velocity ($V_D$).

The feedback velocity ($V_F$) is comprised of two components. First, the dictated velocity ($V_D$) is increased in a step 22 by the dictated acceleration ($A_D$), as determined for one time cycle ($T_D$) in a step 24. This gives a velocity ($V_O$) that would be dictated for zero velocity error. A velocity bias ($V_B$) is determined in a step 26, which is the change in velocity requirement to go from the current dictated acceleration ($A_D$) to the target acceleration ($A_{TARG}$). The velocity bias ($V_B$) is added to the velocity ($V_0$) in a step 28 to form the feedback velocity ($V_f$) which will help bring the dictated velocity ($V_D$) in line with the target velocity ($V_{TARG}$), on a tangential path.

In the open loop control portion of velocity profile generation, target acceleration ($A_{TARG}$) is zero, so that the velocity bias causes the constant negative jerk area from C to D in FIG. 1 (or from C to E in FIG. 2).

Figure 4:
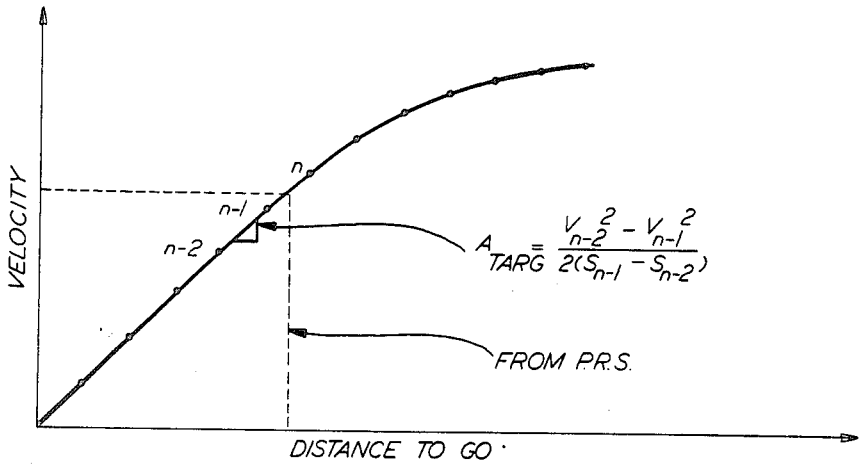
FIG. 4 is a graph illustrating the phase plane lookup concept of this invention.

The phase plane control portion (deceleration) of the velocity profile generation is based on the profile that is generated during the open loop portion of each run, which is stored in the target profile logic generator 10. After a velocity dictation is calculated, its value is stored as one half of a lookup table. The corresponding entry in the table, then, is a distance based upon the velocity. This distance to go is the integral of the velocity profile of FIG. 1 or 2 from the point H, backward to the point E (distance-to-go is essentially zero at point H). When the phase plane control is in effect, distance-to-go is read from a suitable Position Reference System (PRS), such as in U.S. Pat. No. 4,384,275 (Masel, 1983), and is used to find a target velocity and acceleration from the lookup table. The target velocity is interpolated between the points corresponding to those entries that the distance-to-go falls between, and the target acceleration is calculated based on the difference in velocities and distances in the next two entries down the table. This concept is illustrated in FIG. 4. The target velocity and acceleration are again passed through the control block shown in FIG. 3.

Figure 5:
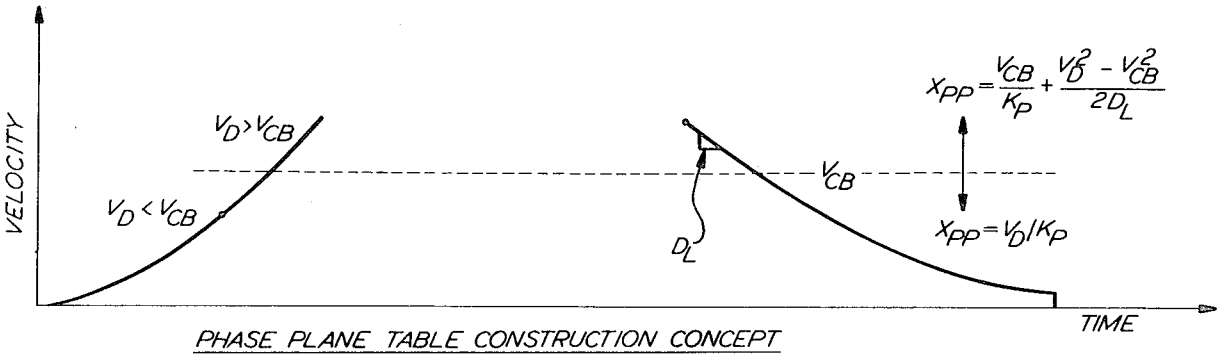
FIG. 5 is a graph illustrating the phase plane table construction concept of this invention.

Storage of the phase plane table takes place only for a portion of any trip. Based upon current dictated velocity, the phase plane table distance is calculated by one of two methods, as shown in FIG. 5. First, when dictated velocity ($V_D$) is below the maximum velocity ($V_{CB}$) of the constant gain region, the phase plane distance is proportional to dictated velocity. This maximum constant gain velocity ($V_{CB}$) is calculated to insure tangency between the constant deceleration curve (F-G) and the constant gain curve (G-H). The relationship is:

$$V_{CB}=d_L/k_p, \quad (1)$$

where $d_L$ is the deceleration limit, and $k_p$ is the gain limit. For dictated velocity greater than $V_{CB}$ the phase plane distance is integrated based upon the dictated velocity and deceleration limit. The deceleration limit may be less in magnitude than the acceleration limit for control purposes (heretofore they were described as nominally equal). Thus, at any given point, the phase plane distance has no direct relationship to the distance actually traveled. Storage of the phase plane table ceases either when one cycle of maximum, negative jerk would cause deceleration to start or when maximum (contract) velocity ($V_k$) is reached. This insures that there will be no state discontinuities in the transition to phase plane control, and occurs at the point D in FIG. 1 (or the point E in FIG. 2).

Figure 6:
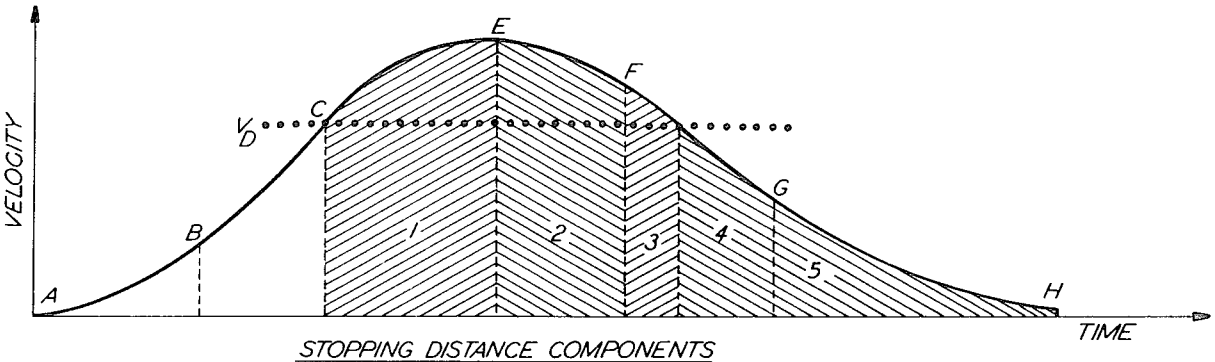
FIG. 6 is a graph illustrating stopping distance components for the velocity profile of this invention for runs where contract speed is not achieved.

Transition from open loop to closed loop control occurs when minimum stopping distance equals the measured distance-to-go. The stopping distance calculation includes the numbered regions in FIG. 6. Region 1 is calculated based on dictated velocity and acceleration so that, if constant velocity is achieved, the area from E to H in FIG. 1 becomes the stopping distance ($S_{stop}$). The equation is:

$$S_{stop} = 1 + 2 + 3 + 4 = \left(V_D \times \frac{a_D}{jL} \times \frac{2a_D^3}{6jL^2}\right) + \left[\left(V_D + \frac{a_D^2 - d_L^2}{2jL}\right) \times \frac{d_L}{jL} + \frac{2d_L^3}{6jL^2}\right] + \left[\left(V_D + \frac{a_D^2 - d_L^2}{2jL}\right)^2 - V_D^2\right] / 2d_L + X_{pp} \quad (2)$$

Where $X_{pp}$ is the distance in the phase plane table corresponding to $V_D$. This value is calculated after the dictated velocity in each processor cycle to determine if the stop control point will be reached by the next cycle.

Special Considerations

Figure 7:
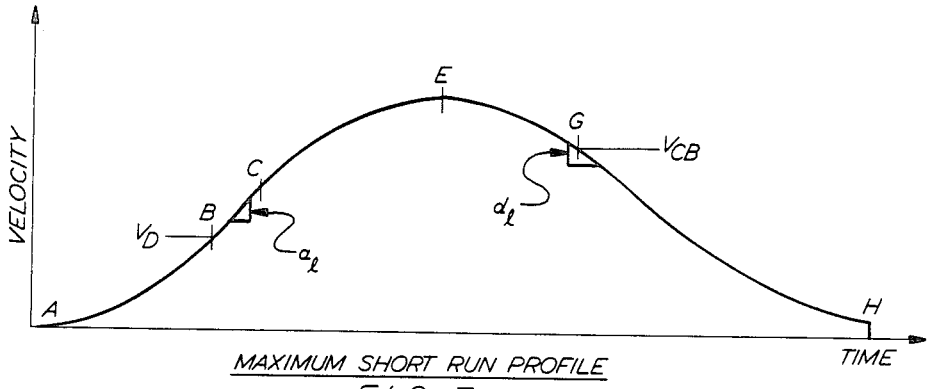
FIG. 7 is a graph illustrating the maximum short run profile of this invention.

There are two special cases to which the above control scheme must adapt. The first case is the possibility that a given trip is so short that the full constant gain profile cannot be built into the phase plane table before the stop control point is reached. This is illustrated in FIG. 7, which shows the conditions for the maximum distance short run. This is the longest run for which the area from F to G in FIG. 1 is zero. In FIG. 7, the instantaneous deceleration level at point G is the maximum magnitude of $d_L$, and the slope from B to C is the contract acceleration limit. The short run stop control point is reached at point B, so that the constant acceleration travel from B to C is guaranteed. This section must be included in the stop control point evaluation because $V_{CB}$ may vary based upon $d_L$ and $k_p$. The short run logic will continue until $V_D$ reaches point C, where $$V_D = V_{cb} + \frac{(d_L^2 - a_L^2)}{2jL} \quad (3)$$

Figure 8:
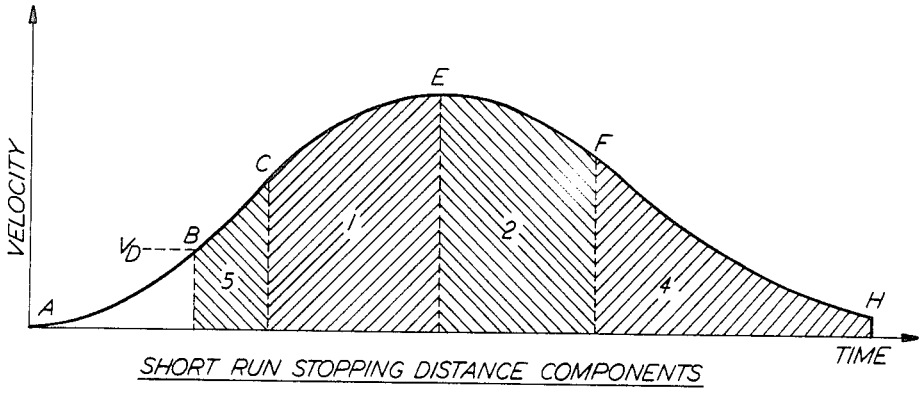
FIG. 8 is a graph illustrating stopping distance components for the velocity profile of this invention for short runs.

The stopping distance must be calculated for a short run using different equations than are used for normal runs. The differences are that the region from F to G in FIG. 2 is omitted while the area from B to C is included. Also, the entire constant gain region will not have yet been included in the phase plane table when the stopping distance is calculated. The calculation, referring to the numbered areas in FIG. 8, is:

$$S_{stop} = 5 + 1 + 2 + 4 = \frac{\left[V_{CB} + \frac{(d_L^2 - a_D^2)}{2jL}\right]^2}{2a_D} - V_D^2 + \left[\left(V_{CB} + \frac{(d_L^2 - a_D^2)}{2jL}\right)\frac{a_D}{jL} + \frac{2a_D^3}{6jL^2}\right] + \left(V_{CB} \times \frac{d_L}{jL} + \frac{2d_L^3}{6jL^2}\right) + V_{CB}/k_p \quad (4)$$

In order to guarantee the profile of FIG. 7 for all short runs, the values of $d_L$, and $V_{CB}$ are dynamically incremented from the beginning of a run in the following manner:

$$d_L = R \times a_d \quad (5)$$

$$V_{CB} = d_L/k_p,$$

Where R is the control margin used for the deceleration profile. These values are incremented until $a_D$ reaches the contract acceleration limit. By calculating region 5 using dictated velocity and acceleration, the stopping distance will actually decrease as $V_D$ increases through that region; and if the system responds without excessive lag, the SCP will not be reached at point C of FIG. 7 if it is not reached by point B. In fact, at the maximum short run distance, (where $V_D$ is satisfied by equation (3); and region 3 of FIG. 6, and region 5 of FIG. 8, are zero), equations (2) and (4) both become $$S_{stop} = \frac{V_D a_D}{jL} + \frac{2a_D^3}{6jL^2} + \frac{V_{CB} d_L}{jL} + \frac{2d_L^3}{6jL^2} + V_{CB}/k_p \quad (6)$$

The second case that the profile generator must adapt to is where drive current, voltage, or power limitations are experienced due to elevator loading. There are two allowances in the control system to accommodate such limitations. First, upon receiving an externally provided signal that the drive is somehow overloaded, the profile generator will command negative jerk in order to reduce torque requirements. Since this is reflected in velocity dictation, and the dictation is used to build the phase plane lookup table for each run, it is expected that such drive limitations will not be exceeded upon deceleration. However, the effect of load imbalance and direction of motion and the effect of friction are different during acceleration than they are during deceleration, and this margin may cause drive limitations during deceleration exceed those during acceleration. This has lead to the second drive accommodating feature of the system. The control factor, R, used to calculate the deceleration limit in equations (5) includes both allowances for a control margin and for the above required drive margin, and may be a function of the load imbalance and direction of motion for each trip. Thus, if the sizing of a drive for a given hoistway indicates that such drive limitation problems are probable, the deceleration limit may be reduced (from nominally equal to the magnitude of the acceleration limit) to suit the system better;

yet the phase plane control will adapt and be able to perform within ride quality constraints.

Adaptive control permits operating a drive unit closer to its limits without danger of overloading under worst case conditions, which account for a small percentage of the time. Thus, smaller drive units can be used in a given application with minimal impact on performance.

Anticipation Margins

Figure 9:
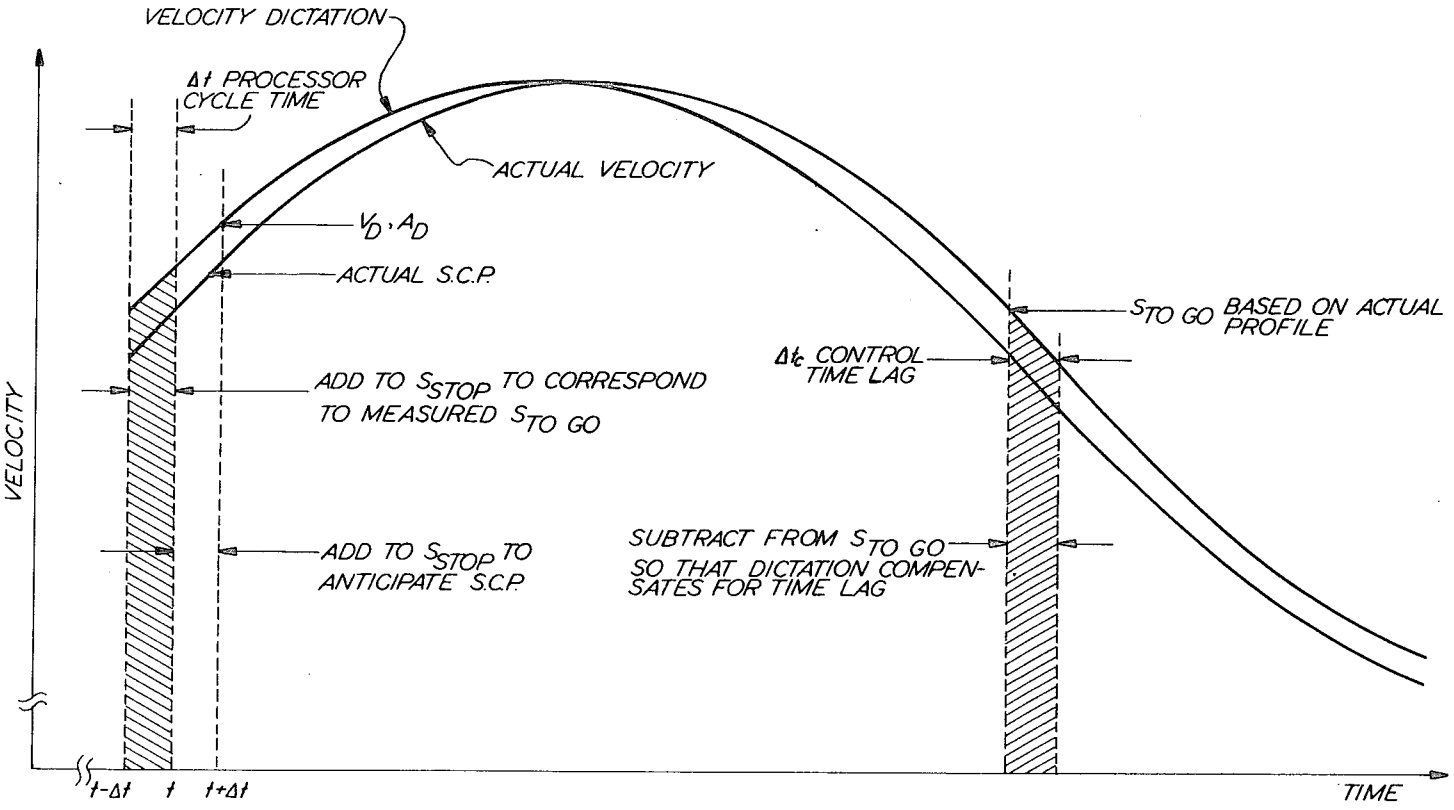
FIG. 9 is an illustration of the lookahead concepts involved in the invention.

Due to the existence of various time lags in an elevator system, some anticipation must be built into a control system. Two such anticipatory factors have been included in the profile generator. First, the SCP is anticipated by adding a look ahead term to the stopping distance calculation. The stopping distance is integrated ahead by two processor cycles before it is compared to distance to go. The correction is:

$$S_{stop,corrected}=S_{stop}+[V_D\times(2\Delta t)+a_D(2\Delta t)^2/2] \quad (7)$$

where $\Delta t$ is the processor cycle time. Inclusion of two time cycles into the look-ahead is explained as follows, and is illustrated on the left side of FIG. 9. One time cycle look ahead is required because values of dictated velocity and acceleration have been calculated for the current cycle, whereas distance to go is read at the beginning of the cycle. One time step integration, then, brings all values that are used for comparison to the same time level. The second time cycle is included to insure that the stop control command is never given late. If the SCP were to be reached within the next time cycle as in FIG. 9, jerk out from full acceleration would not occur until after the SCP. Since the SCP is supposed to be the last point at which transition to deceleration must begin, the control system would lag its proper configuration all the way through the run. Since the invention provides smooth transition from an early stop control command to the desired deceleration profile, but may overshoot the destination floor with a late stop control command, a full cycle of look ahead is added to guarantee that the SCP will never be late.

The second anticipation built in to the profile generator is to allow for the delay in the response of the elevator drive and hoisting mechanism to the control system. This concept is illustrated on the right side of FIG. 9, where the tracking delay ($\Delta t_c$) is dependent upon the drive characteristics, and is generally not equal to the processor cycle time. In order to account for such a delay, a compensation must be made to measured distance to go:

$$S_{to\ go,corrected}=S_{to\ go,measured}-(V_D\times\Delta t_c-a_D\times\Delta t_c^2/2) \quad (8)$$

Calculated in this manner, the compensating factor is small at low speeds, as is the error caused by tracking delay. Measurement of the tracking delay in the manner illustrated assumes that the drive controller uses a proportional plus integral feedback gain loop.

All of the above factors are included in the invention. The dynamic generation of a lookup table enables adaptation of the controls to drive limiting situations. Whether a short or normal run is encountered, much of the same algorithms are used and all the look aheads are the same. The profile generator is flexible enough to adapt itself to the conditions of a given run, while still operating in a timely and efficient manner.

We claim:

1. A method of controlling elevator velocity from zero to a maximum velocity and back to zero comprising the steps:
   (a) increasing velocity at a constant jerk from zero until an acceleration limit is reached;
   (b) increasing velocity at the acceleration limit;
   (c) decreasing acceleration to attain a maximum velocity;
   (d) running the elevator at maximum velocity until a step control point (SCP) is reached;
   (e) decreasing the velocity of the elevator to approach the target velocity value until the velocity is near zero;
   (f) decreasing the velocity to zero at an acceptable jerk;
   (g) during steps a, b, c, generating a lookup table by periodically calculating distance to go using an instantaneous value of dictated velocity and storing corresponding values of instantaneous dictated velocity and calculated distance to go as data sets until the velocity limit is reached;
   (h) during step e periodically calculating a target velocity value by determining the value of dictated velocity corresponding to the instantaneous distance to go value from the generated lookup table by differences between the next two successive data sets with lower distance to go values than the instantaneous distance to go value.

2. A method of controlling elevator velocity from zero to a velocity less than a constant velocity and back to zero comprising the steps:
   (a) increasing velocity at a constant jerk from zero until an acceleration limit is reached;
   (b) increasing velocity at the acceleration limit until a stop control point (SCP) is reached;
   (c) decreasing velocity of the elevator to approach the target velocity until the velocity is nearly zero;
   (d) decreasing the velocity to zero at an acceptable jerk;
   (e) during steps a and b generating a lookup table by periodically calculating distance to go using an instantaneous value of dictated velocity and storing corresponding values of instantaneous dictated velocity and calculated distance to go as data sets until the velocity limit is reached;
   (f) during step c periodically calculating a target velocity value by determining the value of dictated velocity corresponding to the instantaneous distance to go value from the generated lookup table by differences between the next two successive data sets with lower distance to go values than the instantaneous distance to go value.

3. A method according to claim 1 or 2 comprising the step of providing velocity control for an elevator having a velocity profile with a stop control point, and a processor for controlling the elevator stopping, said step comprising:
   calculating a corrected stop control point by calculating a value of stopping distance at least two processor cycles before comparing it to the value of the distance to go.

* * * * *